United States Patent [19]

Snyder

[11] 4,207,393

[45] Jun. 10, 1980

[54] PHOTOGRAPHIC CONTRAST ENHANCERS

[75] Inventor: Warren L. Snyder, St. Paul, Minn.

[73] Assignee: Minnesota Mining and Manufacturing Company, Saint Paul, Minn.

[21] Appl. No.: 19,103

[22] Filed: Mar. 9, 1979

[51] Int. Cl.[2] ..... G03C 1/40; G03C 1/10; G03C 7/00

[52] U.S. Cl. ..... 430/546; 430/554

[58] Field of Search ..... 96/56, 56.5, 66.3, 97, 96/100 R

[56] References Cited

U.S. PATENT DOCUMENTS

| | | | |
|---|---|---|---|
| 2,955,038 | 10/1960 | Smith | 96/109 |
| 3,043,697 | 7/1962 | Forsgard | 96/109 |
| 3,408,194 | 10/1968 | Loria | 96/100 |
| 3,930,866 | 1/1976 | Oishi et al. | 96/56.5 |

*Primary Examiner*—Richard L. Schilling

*Attorney, Agent, or Firm*—Cruzan Alexander; Donald M. Sell; Mark A. Litman

[57] ABSTRACT

Certain phenolic compounds have been found to enhance the contrast of dispersed coupler color photographic elements when the coupler is a 1-phenyl-3-anilino-5-pyrazolone magenta coupler.

11 Claims, No Drawings

PHOTOGRAPHIC CONTRAST ENHANCERS

FIELD OF THE INVENTION

The present invention relates to the field of color photographic emulsions. Particularly, the present invention relates to the use of contrast enhancers in color photographic emulsion layers. These enhancers are found to increase the average and shoulder contrast of color forming couplers in color photographic emulsions.

BACKGROUND OF THE INVENTION

The density of the image in a color photographic emulsion layer is the result of the amount of color photographic coupler which has reacted or coupled with oxidized photographic developer to form a dye. Given a class of color couplers, the conventional way of increasing the dye density for a fixed amount of light exposure has been to increase the amount of area of photographic silver halide or coupler or by increasing the amount of silver halide in the layer per unit of surface area, or to reduce the size of the silver halide grains or combinations of these techniques. By increasing the amount of silver halide or coupler in an emulsion layer, however, the cost of that emulsion layer is also increased significantly.

It has been found in the practice of the present invention that the addition of a certain class of phenolic compounds to a color photographic emulsion layer changes the shape of the conventional D (density) vs log E (energy of exposure) curve so as to desirably change the contrast of the emulsion. The effect of these phenolic compounds is to increase the density of the dye image formed at a given exposure level without necessarily changing the ratio of silver to coupler. In fact, one can maintain a given image dye density at a fixed exposure with reduced amounts of silver halide in the presence of enhancers of the present invention. In addition, the effect of these compounds is apparently somewhat different than that of increasing the amount of coupler or silver in that the portion of the D-log E curve affected by these compounds is different than for changes affected by altering the silver to coupler ratio. The use of these compounds affects the upper portion or the shoulder of the D-log E curve as well as the curve shape. These enhancers are particularly useful with magenta couplers of the 1-phenyl-3-anilino-5-pyrazolone class.

DESCRIPTION OF THE INVENTION

It has been found in the practice of the present invention that certain phenolic compounds may be added to unexposed, undeveloped color photographic emulsions and that these compounds will enhance the contrast of the emulsion. These compounds may be represented by the formula:

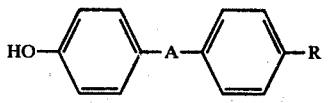

wherein A is selected from the group consisting of

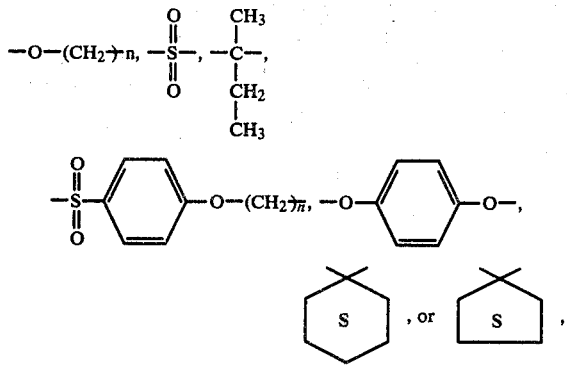

n=1, 2, 3, or 4, and

R=H, OH, alkyl of 1 to 3 carbon atoms, or $CH_3$.

These phenolic compounds have been found to be particularly useful in the contrast enhancement of oil dispersed magenta couplers of the 1-phenyl-3-anilino-5-pyrazolone class. These couplers may be described by the general formula:

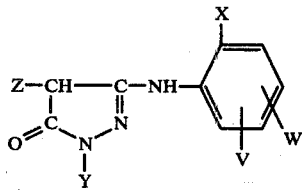

wherein

Y is an aryl group, preferably a phenyl group, and most preferably a halogen substituted phenyl group such as 2,4,6-trichlorophenyl, Z is a leaving or splitting-off group which is releasable from its attached position (the coupling position) when the coupler couples with an oxidized aromatic primary amine color developing agent, W represents a hydrophobic ballasting group, X represents a group selected from the class consisting of alkyl group, aryl group, alkoxy group, aryloxy group, N-substituted amino group, amido group, halogen atom, hydroxyl group, cyano group, or nitro group, and V represents a group selected from hydrogen or a group as defined for X or W.

These couplers are well known in the art, as for example in U.S. Pat. No. 3,930,866. Particularly desirable couplers are those wherein W represents a ballasting group of the formula:

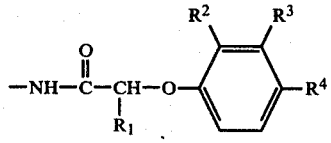

wherein $R_1$ is selected from the class consisting of hydrogen, and alkyl of from 1 to 20 carbon atoms, $R_2$ and $R_4$ are selected from the class consisting of hydrogen and alkyl, alkylene, or alkoxy of from 3 to 18 carbon atoms, $R_3$ is selected from the class consisting of hydrogen and alkyl or alkoxy of from 8 to 30 carbon atoms, with the limitations that when $R_3$ is hydrogen, the sum of the carbon atoms in $R_2$ and $R_4$ is at least 8 and no more than 30, and that when $R_3$ is alkyl or alkoxy, both $R_2$ and $R_4$ are hydrogen, or

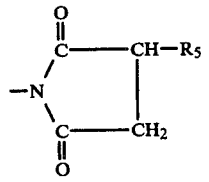

wherein $R_5$ is an alkyl or alkoxy group of from 8 to 30 carbon atoms.

Another desirable ballasting group includes

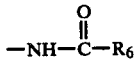

where $R_6$ is an alkyl group of from 8 to 20 carbon atoms.

The enhancers of the present invention may be introduced into the photographic emulsions in a number of ways. The most preferred way is to have the enhancers in the dispersed oil droplets. Another desirable means of introducing the enhancer is to have it within the emulsion, but outside of the droplet. It is believed that the enhancer may penetrate the droplet when this is done, but in any case, the contrast is enhanced when the phenolic compounds of the present invention are so introduced into the emulsion. A less desirable way of introducing the enhancers into the emulsion is by carrying them in the developer solution. The enhancers of the present invention may be present in any effective amount. The preferred amount is approximately an equimolar ratio of the enhancer and pyrozolone coupler. A generally useful range for the molar ratio of enhancers to coupler in the emulsion would be between 0.05/1 and 2.0/1. A more preferred range would be between 0.4/1 and 1.5/1. When the enhancers are present in the developer solution, a weight ratio range of enhancer/developer of between 0.05/1 to 1.8/1 is preferred, and a ratio of between 0.10/1 and 1.0/1 is more preferred.

The action of the enhancers of the present invention is believed to be independent of the halogen nature of the silver halide emulsion. The silver halide may be silver chloride, silver bromide, silver chlorobromide, silver iodobromide, silver iodochlorobromide, or other combinations of iodide, chloride and bromide as the halide. The action of the enhancers of the present invention is also believed to be independent of the nature of the primary aromatic amine photographic developer. The p-phenylene diamine class of developers is most preferred.

Conventional photographic additives may also be used with the enhancers of the present invention. These materials include surfactants, antifoggants, stabilizers, sensitizing dyes, acutance dyes, hardeners, etc.

U.S. Pat. Nos. 2,955,038 and 3,043,697 disclose the use of di-ortho and di-meta bisphenolic comounds having some similarity in structure to the enhancer of the present invention. These compounds are shown as antifoggants in silver halide emulsions. Only black and white emulsions are shown and no oil dispersions are shown therein.

U.S. Pat. Nos. 3,408,294 and 3,655,598 show the use of the group

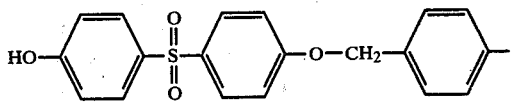

as a leaving group on color photographic couplers. When this group is split off the coupler, it would be one of the enhancers of the present invention. However, these compounds are not present in unexposed, undeveloped emulsions. An unexposed emulsion, according to the practice of the present invention, is an emulsion which has not been sensitized to development by exposure to light and which when developed would show only spurious images, i.e., fog and minimum stain. Any emulsion which when developed according to the complete procedures of Example 1 and shows a D min in excess of 0.25 is an exposed emulsion. A developed emulsion in the practice of the present invention is one in which oxidized photographic color developer, particularly of the primary aromatic amine type, or its coupled product with color photographic couplers, particularly of the 1-phenyl-3-amilino-5 pyrazolone type, is present in the emulsion.

The present invention relates to constructions having these enhancers present in unexposed and undeveloped color photographic emulsions having oil dispersed color photographic couplers of the 1-phenyl-3-anilino-5-pyrazolone type therein.

These and other aspects of the present invention will be shown in the following examples.

In the following examples, the following enhancers and color couplers will be repeatedly referred to:

| Enhancers Number | |
|---|---|
| 1. | 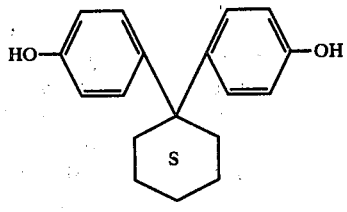 |
| 2. | 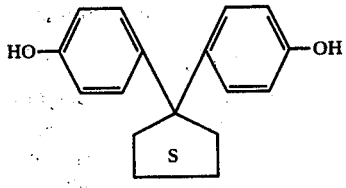 |
| 3. | 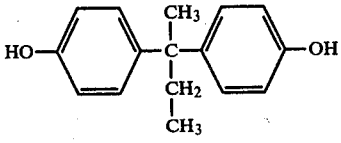 |
| 4. | 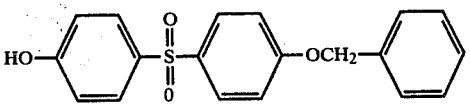 |

-continued
| Enhancers Number | |
|---|---|
| 5. | 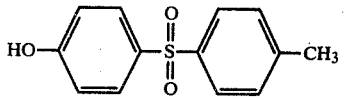 |
| 6. | 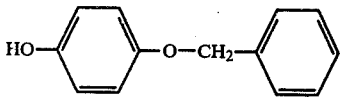 |
-continued
| Enhancers Number | |
|---|---|
| 7. | 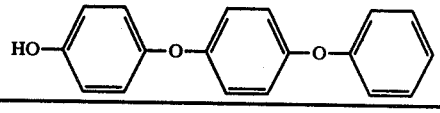 |
| Couplers Number | |
|---|---|
| 1. | 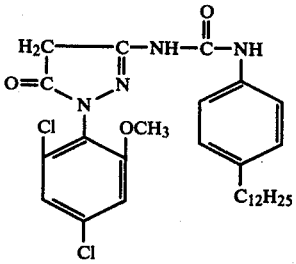 |
| 2. | 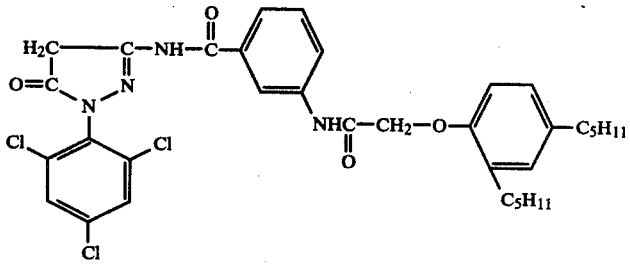 |
| 3. | 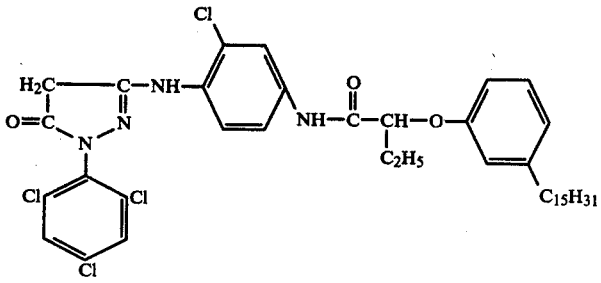 |
| 4. | 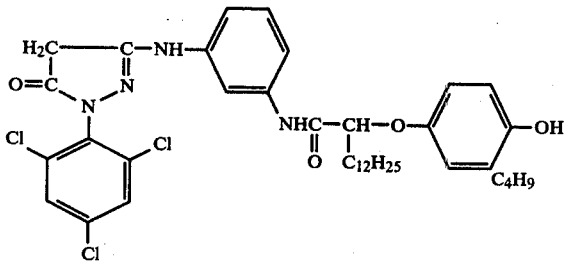 |

-continued

| Couplers Number | |
|---|---|
| 5. | 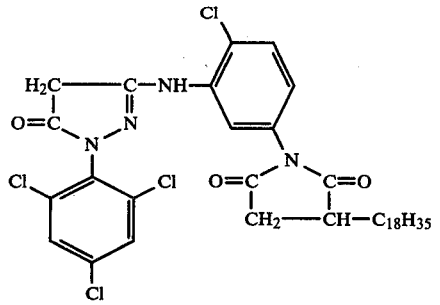 |

EXAMPLES 7.6 gm of coupler #3 and 2.9 gm of enhancer #4 were dissolved in a mixture of 2.6 ml of tricresyl phosphate, 2.6 ml of di-n-butyl phthalate and 23 ml of ethyl acetate. This solution was added to 105 grams of an aqueous solution containing 4.5 gms of gelatin and 1 gm of sodium tetradecyl sulfate. This solution mixture was then stirred with a homogenizer to prepare a coupler dispersion. The resulting coupler dispersion was then mixed with 295 grams of a gelatin silver chlorobromide emulsion (Br: 85 mol% containing 4 gm of silver) which had been spectrally sensitized to green light with a cyanine dye. After adding a gelating hardener and coating aids, this mixture was coated on a paper support, both sides of which were laminated with polyethylene, then dried. The coating thus obtained contained 610 mg/m$^2$ of coupler (Example 2).

In the same manner, the following samples were prepared, using equimolar proportions of the various couplers.

| Example | Coupler | Contrast Enhancing Compound | Amount |
|---|---|---|---|
| 1 | 3 | — | — |
| 2 | 3 | 4 | 2gm |
| 3 | 4 | — | — |
| 4 | 4 | 4 | 2gm |
| 5 | 5 | — | — |
| 6 | 5 | 2 | 2gm |
| 7 | 5 | 4 | 2gm |
| 8 | 5 | 6 | 2gm |
| 9 | 5 | 7 | 2gm |
| 10 | 1 | — | — |
| 11 | 1 | 4 | 2gm |
| 12 | 2 | — | — |
| 13 | 2 | 4 | 2gm |

These samples were then exposed for 0.1 sec with light from a 2950° K tungsten lamp giving 1700 mc illuminance at the filter plane through a 20 cm continuous type M carbon wedge (gradient: 0.20 density/cm), a Wratten 2C ultraviolet absorbing filter and a Wratten #58 green filter. After exposure these samples were processed in the following processing solutions.

| Developer Solution | |
|---|---|
| Ethylene glycol | 21.3 ml |
| Benzyl alcohol | 15.1 ml |
| Potassium carbonate (anhydrous) | 32 gm |
| Potassium sulfite (anhydrous) | 2.1 gm |
| Potassium bromide | 0.6 gm |

-continued

| Developer Solution | |
|---|---|
| Hydroxylamine sulfate | 3.86 gm |
| Nitrilo-tris-methylene phosphonic acid | 0.6 gm |
| 4,4'bis[2-methoxy-4-(di(2-hydroxyethyl) amino)-5-triazin-ylamino]stilbeal-2,2'-disulfonic acid disodium salt | 1.0 gm |
| Lithium sulfate | 1.78 gm |
| Potassium Chloride | 0.25 gm |
| N[2-[N-ethyl-N-(4-amino-3-methylphenyl) amino]-ethyl]methanesulfonamide sesquisulfate (monohydrate) | 4.85 gm |
| Potassium hydroxide (45% solution) | 1.1 ml |
| Water to make | 1000 ml |
| (pH 10.1) | |

| Bleach-Fix Solution | |
|---|---|
| Ferric Ammonium EDTA (1.56 Molar solution) | 106 ml |
| Ammonium thiosulfate (58% solution) | 120 ml |
| Sodium bisulfite | 13 gm |
| Ammonium hydroxide (28% ammonia solution) | 30 ml |
| EDTA (Ethylene diamine tetraacetate acid) | 35 gm |
| Water to make | 1000 ml |
| (ph 8.8) | |

| Processing Step | Temp (°C.) | Time |
|---|---|---|
| Developer | 33 | 4 mn 30 sec |
| Bleach-Fix | 33 | 1 mn 30 sec |
| Wash | 30–36 | 3 mn |
| Dry | 20–90 | 30 sec to 5 mn |

After processing, status D densitometry was measured. The results obtained are shown in Table 1.

TABLE 1

| Sample # | Magenta Dmax | Magenta Gamma | Cplr # | Enhancer # |
|---|---|---|---|---|
| 1 | 1.64 | 1.29 | 3 | — |
| 2 | 1.65 | 1.51 | 3 | 4 |
| 3 | 1.59 | 1.32 | 4 | — |
| 4 | 1.60 | 1.56 | 4 | 4 |
| 5 | 1.62 | 1.27 | 5 | — |
| 6 | 1.67 | 1.67 | 5 | 2 |
| 7 | 1.64 | 1.56 | 5 | 4 |
| 8 | 1.63 | 1.51 | 5 | 6 |
| 9 | 1.68 | 1.67 | 5 | 7 |
| 10 | 1.59 | 1.17 | 1 | — |
| 11 | 1.62 | 1.22 | 1 | 4 |
| 12 | 1.59 | 1.04 | 2 | — |
| 13 | 1.54 | 0.96 | 2 | 4 |

It is clear from the results shown in Table 1 above that the samples using the contrast enhancing compounds of the present invention with couplers of the preferred types provide a marked increase in gamma. Couplers Nos. 1 and 2 are outside the scope of the present invention, and it is shown that the enhancers do not work for that class of coupler.

EXAMPLE 14

In the same manner as described in Examples 1–13, coupler dispersions including enhancers of the present invention for a green sensitive layer were prepared, and samples having the following layer structure were prepared.

| Layer | | | |
|---|---|---|---|
| #6 | Top Coat | | |
| | Gelatin | 1 | gm/m² |
| #5 | Red sensitive layer | | |
| | Gelatin | 1.6 | gm/m² |
| | Ag-Br-Cl emulsion (Br: 85 mol%) | | |
| | Silver | 350 | mg/m² |
| | Cyan coupler | 470 | mg/m² |
| #4 | Interlayer | | |
| | Gelatin | 1.3 | gm/m² |
| | [1]ultraviolet light absorber | 730 | mg/m² |
| #3 | Green sensitive layer | | |
| | Gelatin | | |
| | Ag-Br-Cl emulsion | 1.5 | gm/m² |
| | (Br: 85 mol%) Silver | 320 | mg/m² |
| | Magenta coupler #5 | 680 | mg/m² |
| | Contrast enhancer (see Table 2 below) | | |
| #2 | Interlayer | | |
| | Gelatin | 700 | mg/m² |
| #1 | Blue Sensitive Layer | | |
| | Gelatin | 2.2 | gm/m² |
| | Ag-Br-Cl emulsion | | |
| | (Br: 88 mol%) Silver | 400 | mg/m² |
| | Yellow coupler | 440 | mg/m² |

[1]2-(2'-hydroxy-3',5'-di-t-amylphenyl)benzotriazole

After preparation of these coatings, they were processed and sensitometry and densitometry were evaluated as described in Examples 1–13. The results are presented in Table 2.

Table 2

| Sample # | Contrast Enhancer | Magenta Dmax | Magenta Gamma |
|---|---|---|---|
| 14 | none | 2.30 | 1.73 |
| 15 | #1 | 2.35 | 2.09 |
| 16 | #3 | 2.38 | 2.10 |
| 17 | #4 | 2.55 | 2.59 |
| 18 | #5 | 2.42 | 2.19 |
| 19 | #7 | 2.38 | 2.23 |

As can be seen from these examples, the contrast enhancers provide an increase in magenta layer contrast and Dmax in magenta emulsion layers in tripack constructions.

EXAMPLES 20–24

Multilayer coatings were prepared as described in examples 14–19 except that the contrast enhancing compounds were incorporated into the coatings in two different ways.

2.7 gm of coupler enhancing compound were dissolved in 1 ml of tricresyl phosphate, 1 ml of di-n-butyl phthalate and 5.5 ml of ethyl acetate. This solution was added to 45 gms of an aqueous solution containing 1.6 gms of gelatin and 0.5 gm of sodium tetradecyl sulfate. The resulting solution mixture was then stirred with a homogenizer to make a dispersion of the contrast enhancer. This dispersion was then added to a coating solution similar to Example 14 in such a way that the silver and coupler concentrations were unaltered; that is, this dispersion was added in substitution for some of the water of dilution used in preparing an emulsion for coating.

This auxilliary dispersion was added to the coating solutions of the emulsion and the coupler dispersion such that the amount of contrast enhancer added in the emulsion was the same as that which would have been included in the coupler dispersion itself. (See Table 3) These samples were then coated and processed and sensitometry and densitometry were measured as in Examples 1–13. The results are set forth in Table 3 below. In these cases the silver was coated at 510 mg/m² and the coupler at 620 mg/m².

TABLE 3

| Sample # | Contrast Enhancer | Amount Relative to Coupler (wt%) | How Incorporated | Magenta Dmax | Magenta Gamma |
|---|---|---|---|---|---|
| 20 | — | — | — | 2.19 | 1.35 |
| 21 | #3 | — | auxillary | 2.31 | 1.65 |
| 22 | #3 | — | in coupler dispersion | 2.34 | 1.73 |
| 23 | #4 | — | auxillary | 2.41 | 1.73 |
| 24 | #4 | — | incoupler dispersion | 2.43 | 1.92 |

As these results make clear, the contrast enhancing effect of the compounds of the present invention can be achieved, albeit to a lesser extent, even though the enhancing compound and the coupler do not reside within the same oil droplet of the coupler dispersion.

EXAMPLE 25

A multi-layer coating similar to that of Example 20 was prepared. Exposure of this sample was as described in Examples 1–13. Processing was performed in three different ways in the development step, which are shown in Table 4. Processing steps subsequent to development were as in Examples 1–13.

Table 4

| Sample # | Developer |
|---|---|
| 25A | as in Example 1 1700 ml |
| 25A | as in Example 1 1650 ml + 50 ml methanol |
| 25A | as in Example 1 1650 ml + 50 ml of 6% by weight solution of cmpd #4 in methanol |

The results of this procedure are as follows:

| Sample # | Magenta Dmax | Magenta Gamma |
|---|---|---|
| XXI A | 2.54 | 1.97 |
| XXI B | 2.54 | 1.95 |
| XXI C | 2.57 | 2.42 |

This example shows that the enhancers of the present invention may be present in the developer solutons in order to provide contrast enhancement on magenta emulsion layers.

I claim:

1. An unexposed, undeveloped color photographic silver halide dispersion in a layer comprising a hydrophilic colloid, silver halide, and an oil droplet dispersion of a 1-phenyl-3-anilino-5-pyrazolone color photographic coupler, wherein said layer also contains therein an effective amount of a contrast enhancer of the formula

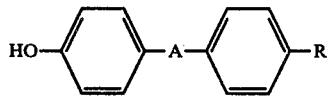

wherein A is selected from the group consisting of

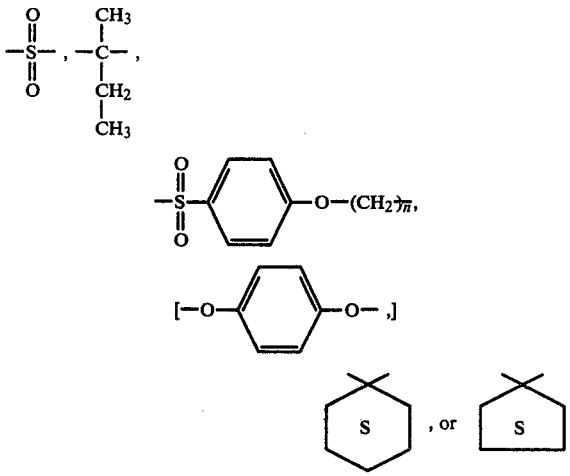

wherein n is 1, 2, 3, or 4, and

R is H, OH, or alkyl of 1 to 3 carbon atoms.

2. The layer of claim 1 wherein said contrast enhancer is present in an amount which provides a molar ratio of enhancer/color coupler of between 0.05/1 and 2/1.

3. The layer of claim 2 wherein at least some of said contrast enhancer is present in the dispersion within oil droplets within which said color photographic couplers are dissolved.

4. The layer of claim 1 wherein said contrast enhancer is present in an amount which provides a molor ratio of enhancer/color coupler of between 0.4/ and 1.5/1.

5. The layer of claim 4 wherein at least some of said contrast enhancer is present in the dispersion within oil droplets within which said color photographic couplers are dissolved.

6. The emulsion of claim 4 wherein A is

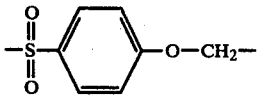

wherein R is H.

7. The emulsion of claim 5 wherein A is

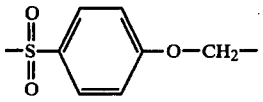

wherein R is H.

8. The layer of claim 1 wherein at least some of said contrast enhancer is present in the dispersion within oil droplets within which said color photographic couplers are dissolved.

9. The emulsion of claim 8 wherein A is

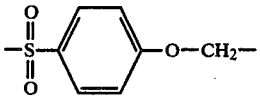

wherein R is H.

10. The emulsion of claim 1 wherein A is

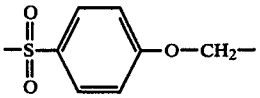

wherein R is H.

11. An unexposed, undeveloped color photographic silver halide dispersion in a layer comprising a hydrophilic colloid, silver halide, and an oil droplet dispersion of a 1-phenyl-3-anilino-5-pyrazolone color photographic coupler, wherein said layer also contains therein an effective amount of a constrast enhancer of the formula

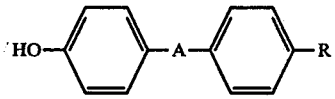

wherein A is selected from the group consisting of

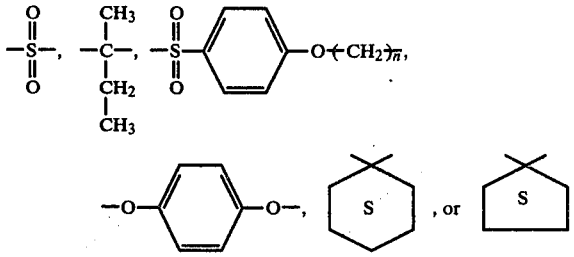

wherein n is 1, 2, 3, or 4, and

R is H, OH, or alkyl of 1 or 3 carbon atoms.

* * * * *

UNITED STATES PATENT AND TRADEMARK OFFICE

CERTIFICATE OF CORRECTION

PATENT NO. : 4,207,393

DATED : June 10, 1980

INVENTOR(S) : Warren L. Snyder

It is certified that error appears in the above-identified patent and that said Letters Patent are hereby corrected as shown below:

Column 11, line 25 in Claim 1, delete bracketed formula

Signed and Sealed this

*Tenth* Day of *February 1981*

[SEAL]

*Attest:*

RENE D. TEGTMEYER

*Attesting Officer*

*Acting Commissioner of Patents and Trademarks*